US005218933A

United States Patent [19]

Ehrlich

[11] Patent Number: 5,218,933

[45] Date of Patent: Jun. 15, 1993

[54] INTERNAL COMBUSTION ENGINES

[75] Inventor: Josef Ehrlich, Berkhampstead, England

[73] Assignee: Environmental Engines Limited, United Kingdom

[21] Appl. No.: 859,395

[22] PCT Filed: Nov. 28, 1990

[86] PCT No.: PCT/GB90/01850

§ 371 Date: May 27, 1992

§ 102(e) Date: May 27, 1992

[87] PCT Pub. No.: WO91/08377

PCT Pub. Date: Jun. 13, 1991

[30] Foreign Application Priority Data

Nov. 28, 1989 [GB] United Kingdom ..... 8926818

[51] Int. Cl.[5] ..... F02B 75/26

[52] U.S. Cl. ..... 123/56 C; 123/58 A

[58] Field of Search ..... 123/56 C, 51 R, 51 A, 123/51 B, 58 A, 58 AM, 197.1

[56] References Cited

U.S. PATENT DOCUMENTS

| | | | |
|---|---|---|---|
| 1,810,688 | 6/1931 | Toce et al. | 123/56 C |
| 3,396,709 | 8/1968 | Robicheaux | 123/56 C |
| 3,584,610 | 6/1971 | Porter | 123/56 C |
| 3,604,402 | 9/1971 | Hatz | 123/56 C |
| 3,735,741 | 5/1973 | Hatz | 123/56 C |
| 4,363,295 | 12/1982 | Brandly | 123/56 C |
| 4,545,336 | 10/1985 | Waide | 123/56 C |
| 4,834,033 | 5/1989 | Larsen | 123/56 C |
| 4,974,555 | 12/1990 | Hoogerboom | 123/56 C |

FOREIGN PATENT DOCUMENTS

| | | | |
|---|---|---|---|
| 3313611 | 10/1984 | Fed. Rep. of Germany . | |
| 3326294 | 1/1985 | Fed. Rep. of Germany . | |
| 3345510 | 6/1985 | Fed. Rep. of Germany | 123/56 C |
| 636909 | 3/1962 | Italy | 123/56 C |
| 2126279 | 3/1984 | United Kingdom . | |

*Primary Examiner*—David A. Okonsky

*Attorney, Agent, or Firm*—Finnegan, Henderon, Farabow, Garrett & Dunner

[57] ABSTRACT

An internal combustion engine includes at least one piston (1) which is reciprocally received in a cylinder (2) which is coupled to a rotary output shaft (17) by a coupling (5, 22) which converts reciprocal movement of the piston into rotary movement of the output shaft. The engine is so arranged that, in use, the fuel/air mixture in the or each cylinder ignites at a predetermined ignition time in the operation cycle of the engine. The coupling is so arranged or programmed that on its compression stroke the speed of the piston deceases abruptly substantially at the ignition time and that the speed of the piston subsequently increases prior to reaching the top dead center position.

11 Claims, 5 Drawing Sheets

INTERNAL COMBUSTION ENGINES

The present invention relates to internal combustion engines of two stroke or four stroke type and is concerned with that type of engine which includes at least one piston which is reciprocably received in a cylinder and which is coupled to a rotary output shaft by a coupling which converts the reciprocal movement of the piston into rotary movement of the output shaft, the engine being so arranged that, in use, the fuel/air mixture in the or each cylinder ignites at a predetermined time in the operating cycle of the engine, which will be referred to herein as the ignition time. The invention relates also to a method of operating such an engine.

In conventional engines, the output shaft constitutes a crankshaft and the coupling between the or each piston and the output shaft constitutes a respective crank which is rigidly connected to the output shaft and rotatably coupled to a piston rod which is in turn connected to the piston by a connection which permits at least limited relative rotational movement. The use of such a crankshaft is of course long established and well proven and has the inevitable consequence that the position and speed of the or each piston at any movement is precisely determined by the geometry of the associated piston rod and crank and is wholly independent of the progress and nature of the combustion process within the cylinder.

The efficiency of operation of an internal combustion engine is governed by a large number of interrelated complex factors and these include the completeness and speed of the flame propagation through the air/fuel mixture and the relationship between the instantaneous position of the piston and the progress of the combustion process.

Since, in a conventional engine, the instantaneous position of the piston is determined solely by geometrical considerations, as explained above, efforts must be made to match the progress of the combustion process to the movement of the piston. Ignition of the fuel air mixture, whether by a spark in a spark-ignited engine or due to compression in a diesel engine, occurs at a predetermined point which is typically 5° to 40° before the top dead centre postion (TDC). Combustion of the fuel takes places from the ignition point until anything up to typically about 40° after TDC. Combustion of the fuel takes place in two indistinct overlapping stages, the first of which is flame propagation in which the flame spreads from the point at which ignition initially occurs throughout the entire air/fuel mixture and in the second of which the fuel is actually burnt and the power output of the engine is produced. In a conventional engine it is desirable that the flame propagation is essentially complete before TDC and since the rate of flame propagation is an inverse function of the pressure of the air/fuel mixture this places a practical limit on the maximum compression ratio that can be used and necessitates the use of additional measures to maximise the rate of flame propagation before the increasing pressure of the air/fuel mixture results in a significant decrease in the flame propagation rate. Thus whilst it is desirable to increase the compression ratio because this increases the mean effective pressure (m.e.p.) and thus the power output and also the efficiency of the engine, the factor refered to above places a practical upper limit on the compression ratio. The necessity of maximising the flame propagation rate generally requires the production of swirl and/or turbulence in the air/fuel mixture by the provision of a complex combustion chamber shape, swirl-inducing inlet ports, squish areas and the like, all of which add to the complexity and cost of the engine.

Notwithstanding the various measures referred to above which are generally taken in connection with conventional reciprocating piston engines, the efficiency of combustion still remains relatively low. This results not only in the power output and efficiency of the engine being considerably less than that which would be theoretically achieveable but also in the engine exhaust gases containing significant quantities of unburnt or partially burnt fuel, principally in the form of hydrocarbons and carbon monoxide. The presence of such pollutants in the exhaust gas is becoming increasingly unacceptable on environmental grounds and in order to meet increasingly strict environmental regulations it is frequently necessary to fit vehicles with an oxidising catalyst to complete the combustion of these pollutants. Such catalysts are not only expensive but are subject to the risk of failure, e.g. due to catalyst poisoning resulting from the inadvertent use of leaded fuel.

A further problem which arises with internal combustion engines relates to the production of various nitrogen oxides (NOx). NOx is now recognised as a particularly harmful pollutant. Its formation is promoted by high exhaust gas temperatures and various designs of engine whose aim is increased efficiency have resulted in increased production of NOx. Pollution regulations increasingly require the fitting of a reduction catalyst to motor vehicles to eliminate NOx from exhaust gases and this further adds to the cost of the vehicle.

In a conventional engine with a crankshaft, the speed of the piston progressively increases from bottom dead centre (BDC), reaches a maximum at 90° before TDC and thereafter progressively decreases until it reaches zero at TDC. The rate of decrease of speed, i.e. the deceleration of the piston increases progressively from 90° before TDC to TDC. On the downstroke this pattern is reversed. The movement of the piston of a conventional engine is shown by the solid line of FIG. 2 in which piston displacement is shown on the vertical axis and crankshaft angle on the horizontal axis.

It has been recognised by the inventor that many of the problems referred to above are caused, at least in part, by the nature of the movement of the piston with time and thus by the use of a crankshaft to convert the reciprocating motion of the piston into rotational movement of the output shaft. Engines which use a different form of coupling with the output shaft and which thus do not incorporate a crankshaft are known and one example of such an engine is disclosed in U.S. Pat. No. 4,834,033. This engine has two opposed pistons which oscillate in antiphase and are connected to a common piston rod which is guided so as to be movable only parallel to its length. Rollers projecting from the piston rod engage the sides of a cam groove in a carriage secured to the output shaft. Linear movement of the rollers in contact with the sides of the groove, which constitute cam surfaces, results in rotation of the output shaft. However, the cam surfaces in this engine are of regular, generally sinusoidal shape and the motion of the piton thus mimics that in a conventional engine with a crankshaft. The problems referred to above are thus not solved by this engine.

It is the object of the present invention to eliminate or reduce the problems referred to above and, in particular, to construct the engine so that the fuel is burnt more completely than is usual so that the power output and efficiency of the engine are increased and preferably also the need for an oxidising catalyst in the exhaust gas flow is eliminated. It is a further object to construct the engine so that the temperature of the exhaust gas is reduced whereby the production of NOx is reduced and the need for an oxidising catalyst is reduced or eliminated.

According to the present invention an internal combustion engine of the type referred to above is characterised in that the coupling is so arranged or programmed that on its compression stroke the speed of the piston decreases abruptly substantially at the ignition time and that the speed of the piston subsequently increases prior to reaching the top dead center position.

Thus in the engine of the present invention the piston decelerates abruptly at or near the ignition time which means that immediately after the fuel ignites the volume of the cylinder is decreased only slightly, if at all, and in any event at a rate less than in a conventional engine by continued movement of the piston. This is in contrast to a conventional engine in which in the 90° prior to TDC the rate of deceleration increases smoothly and progressively. The fact that the rate of compression of the mixture is thus briefly reduced or interrupted permits flame propagation to proceed more rapidly than is usual without there being any need for a complex combustion chamber, swirl-inducing inlet ports, squish areas or the like. Once the flame has propagated throughout the fuel/air mixture compression may continue in the usual manner. The fact that the piston moves more slowly than usual for a short period after the ignition time, typically from 35° to 15° before TDC to 20° to 8° before TDC, means of necessity that it must subsequently speed up again to a speed greater than was previously usual shortly before TDC so as to reach TDC at the correct time. However, due to the fact that by the time this further compression occurs the flame front has already propagated throughout the fuel/air mixture it is possible to compress the mixture to a greater degree than was previously possible due to the need not to inhibit flame propagation, that is to say it is possible to operate with a substantially increased compression ratio. This increases the m.e.p. and thus results in an increased power output. The complete propagation of the flame throughout the fuel results in more complete combustion and reduced fuel consumption for the same power output than was previously possible and thus in a substantial reduction in unburnt exhaust emissions.

Relatively little power is produced at and very near to TDC and in a conventional engine the piston only moves away from TDC relatively slowly through at a progressively increasing speed. However, it is desirable after TDC to increase the volume of the burning air/fuel mixture as rapidly as possible so as to promote complete combustion and maximise the power obtained from the combustion.

Thus in a preferred embodiment of the invention, the maximum acceleration and preferably also the maximum speed, of the piston on its working stroke is reached at a position between 0° and 40°, preferably 0° and 20°, after TDC. It will be appreciated that this is in sharp distinction to a conventional engine in which the maximum speed and acceleration of the piston on its working stroke are reached at 90° after TDC.

This rapid increase in the volume of the ignited fuel/air mixture shortly after TDC, that is to say more rapid movement of the piston shortly after TDC than in a conventional engine, means of necessity that the piston must move more slowly than in a conventional engine in the latter portion of its working stroke because the piston must reach BDC at a set time. This reduced rate of expansion of the fuel/air mixture towards the end of the working stroke, during which little power is in any event produced, results in a decreased temperature of the exhaust gases and thus in a decreased production of NOx. It will be appreciated that the reduced temperature of the exhaust gas coupled with the sharp reduction in unburnt hydrocarbons results in a decrease in errosion and corrosion of the exhaust port(s) and of the exhaust valve(s), if provided.

The engine in accordance with the invention is thus constructed in accordance with a totally different principle to that conventionally used. Thus in a conventional engine the movement of the piston is determined by the kinematics of the connecting rod and crankshaft and attempts are made to match the combustion as nearly as possible to this movement. However, in the present invention the combustion is permitted to proceed in the optimum manner and the piston is programmed to move in a manner which "follows" and is fully related to the nature and progress of the combustion process. This inherently results in the combustion efficiency and power output being increased, particularly if advantage is taken of increasing the compression ratio to a value above that which was previously thought to be practicable, and in the pollutant emission being reduced.

The invention is applicable not only to two stroke engines of spark-ignited and diesel type but also to four stroke engines of both types. Since the present invention is concerned only with modifying the piston movement during the compression and working strokes, if the engine is of four stroke type the piston may perform either the same modified movement pattern or any other movement pattern during the exhaust stroke. If the engine is of spark-ignited type the ignition time is of course defined by the engine ignition system. If the engine is of diesel type ignition occurs at a time which is predetermined by the compression ratio and the characteristics of the fuel used.

It is of course not unusual to alter the ignition timing of a spark-ignited engine to match its operating condition and in particular the ignition time commonly differs between the start-up condition and normal hot running condition. Whilst it would be possible to introduce a variable timing element into the coupling between the piston and the output shaft to match the variation in ignition timing, it is preferred that this not be done and that the abrupt change in speed of the piston occurs at or around the ignition time in the normal operating state of the engine.

Reference in this specification to degrees before or after TDC are to be interpreted in the usual manner which relates to degrees of rotation of the crankshaft. If the engine is constructed so that the output shaft performs a complete revolution for each cycle of the piston this term will relate to degrees of rotation of the output shaft. However, the elimination of the crankshaft open up the possibility of the piston performing two or more cycles for each revolution of the output shaft, which has the advantage of increased output torque, and in this event the reference to degrees before or after TDC must be interpreted accordingly, i.e. if the shaft rotates once for each three cycles of the piston then 9° before TDC will correspond to a rotation of the output shaft through 3°.

The coupling between the piston and the output shaft may take many forms but in one embodiment the coupling includes a connecting rod connected to the or each piston, the connecting rod being guided to perform only linear movement in the direction of its length, and a cam rotationally fixedly secured to the output shaft, the cam including a continuous annular cam surface which extends around the output shaft and is so shaped that its distance from the piston progressively successively increases and decreases as the output shaft rotates and that the connecting rod is in sliding or rolling engagement with the cam surface. This is, however, not essential and different types of coupling may be envisaged, some of which may have no connecting rod at all. The precise form of the coupling is not crucial provided that it is capable of converting reciprocal movement to rotary movement and is capable of constraining the piston to move in the manner referred to above.

The engine may include only a single piston or a number of pistons connected to the output shaft either through the same coupling or thorugh respective couplings. The engine may of course also include more than one output shaft, e.g. if the cylinders are arranged in a V configuration.

Further features and details of the invention will be apparent from the following description of certain specific embodiments which is given by way of example with reference to the accompanying drawings, in which.

Figure 1:
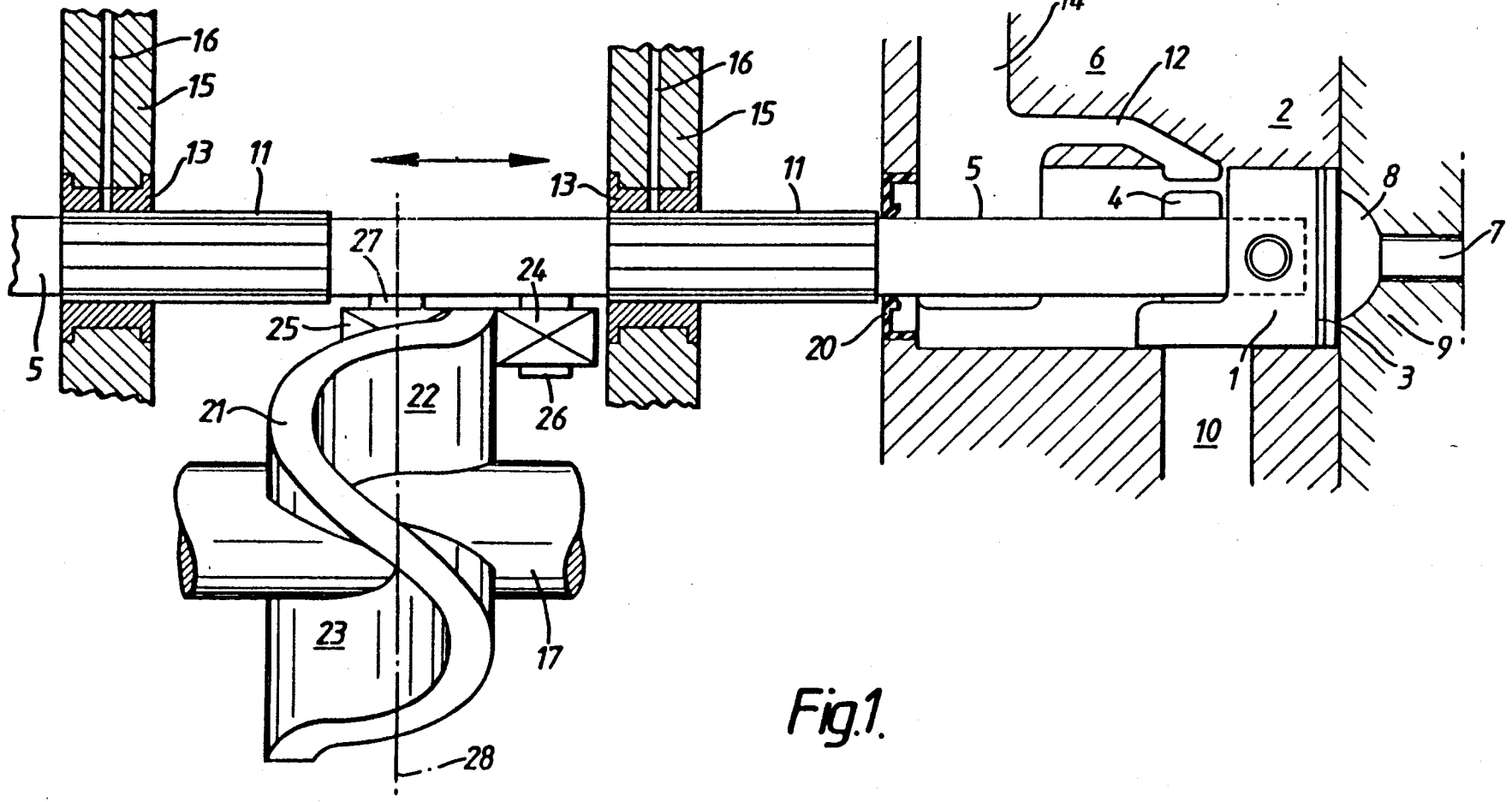
FIG. 1 is a scrap side view, partly in section, of a two-stroke engine in accordance with the invention.

FIG. 1 shows part of a two cylinder two-stroke engine including two identical, symmetrically arranged pistons 1, of which only one is shown, connected to a common connecting rod 5. Each piston 1 is reciprocable within a respective cylinder 2 defined by the engine block or body 6 and has one or more piston rings 3. Each cylinder is closed by a respective cylinder head 9 which defines a simple, generally hemispherical combustion chamber 8. The head 9 is provided with an aperture 7 for receiving a spark plug (not shown). Each cylinder has a piston-controlled exhaust port 10 and a piston-controlled inlet port 4 which communicates via a transfer passage 12 with a pump chamber and inlet 14 which is provided with the usual valve, e.g. of Reed type.

The connecting rod 5 is guided to move only linearly parallel to its length by two spaced groups of splines 11 on its outer surface which engage in respective splined bushes 13 carried by spaced supporting webs 15 which form part of the main engine body 6. The bushes 13 are spaced apart by a distance slightly greater than the stroke of the connecting rod. Lubricant is supplied to the meshing splines through oil passages 16 provided in the webs 15. Between each group of splines 11 and the associated piston, the connecting rod 5 is engaged by a lip seal 20.

Extending parallel to the connecting rod is a rotary output shaft 17 to which the reciprocating motion of the connecting rod 5 is transmitted and converted into rotational movement of the shaft 17 by an annular cam disc 21 which is fixedly connected to and extends generally radially from the shaft 17. The cam disc 21 has opposed annular cam surfaces 22 and 23 facing in opposite directions generally in the direction of the length of the shaft 17. The cam disc 21 is not a simple planar disc but is convoluted in the circumferential direction with respect to its central radial plane 28. Each surface 22,23 is thus spaced from each piston in the direction of the length of the connecting rod 5 by a distance which successively progressively increases and decreases whereby each surface 22,23 has a number of peaks and troughs, in this case three of each. The distance between the peaks on the two surfaces 22,23 in the direction of the length of the shaft 17 is equal to the stroke of the connecting rod.

Each cam surface 22,23 is engaged by a respective guide roll 24,25 rotatably mounted on a respective stub shaft 26,27 projecting radially from the connecting rod 5.

In use, the two pistons move in antiphase and thus the power produced during the working stroke of each piston is transmitted through the connecting rod 5 to effect the compression stroke of the other piston. The rolls 24,25 move with the connecting rod 5 and since the shaft 17 is secured against axial movement and since the surfaces 22,23 are inclined to the direction of movement of the connecting rod 5 the reciprocating motion of the connecting rod is converted into rotational motion of the shaft 17. Since each cam surface 22,23 has three peaks, the shaft 17 rotates only one third of a revolution for each cycle of the pistons which results in an increase of at least three in the output torque as compared with a conventional engine. Although FIG. 1 shows only one opposed piston pair associated with the cam 21, it will be appreciated that there may be only a single piston so associated or a larger number of individual pistons or piston pairs. An important advantage of the use of pairs of pistons linked by a common connecting rod and moving in antiphase is that the varying forces caused by ignition in the two cylinders are largely balanced and there are of course no eccentric forces caused by the rotation of cranks. The forces produced in the connecting rod are all linear and the piston is thus not subject to lateral forces, whereby its service life and that of the pistons is increased. Since the cam 21 is sandwiched between the rolls 24,25 the position of the pistons at any moment is determined precisely by the shape of the cam surfaces 22,23, i.e. the detailed configuration of that portion of the cam surfaces which is in contact with the rolls at that moment. If the cam surfaces were of regular sinusoidal shape the motion of the pistons would mimic that of the pistons of a conventional engine. However, in accordance with the invention the cam surfaces are so shaped that whilst the piston motion is approximately conventional over much of the compression stroke, it slows down abruptly at the ignition time and then subsequently speed up prior to TDC and then moves further than in conventional engines, i.e. to a high compression ratio. Due to the slowing down of the piston at or around the ignition time, the flame propagates rapidly throughout the fuel/air mixture and is not impeded by the substantial rise in pressure which occurs in a conventional engine. Once the flame has spread throughout the fuel the compression rate is increased again to a higher compression ratio than previously without any deleterious effects whereby the m.e.p. and thus efficiency of the engine are increased and combustion of the fuel is substantially complete. After TDC the piston is moved downwards very rapidly and reaches it maximum acceleration, and probably maximum speed also, within 40° and preferably 20° from TDC. This further enhances the combustion rate and efficiency and in effect bring the combustion forward somewhat in the working stroke. Whilst the exhaust port of a two stroke engine is normally opened about 80° before TDC, the acceleration of the combustion which occurs in the present invention permits opening of the exhaust valve to be delayed, e.g. by 10° to 70° before TDC. This further increases the power output of the engine and is found not to reduce the scavenging efficiency.

Figure 2:
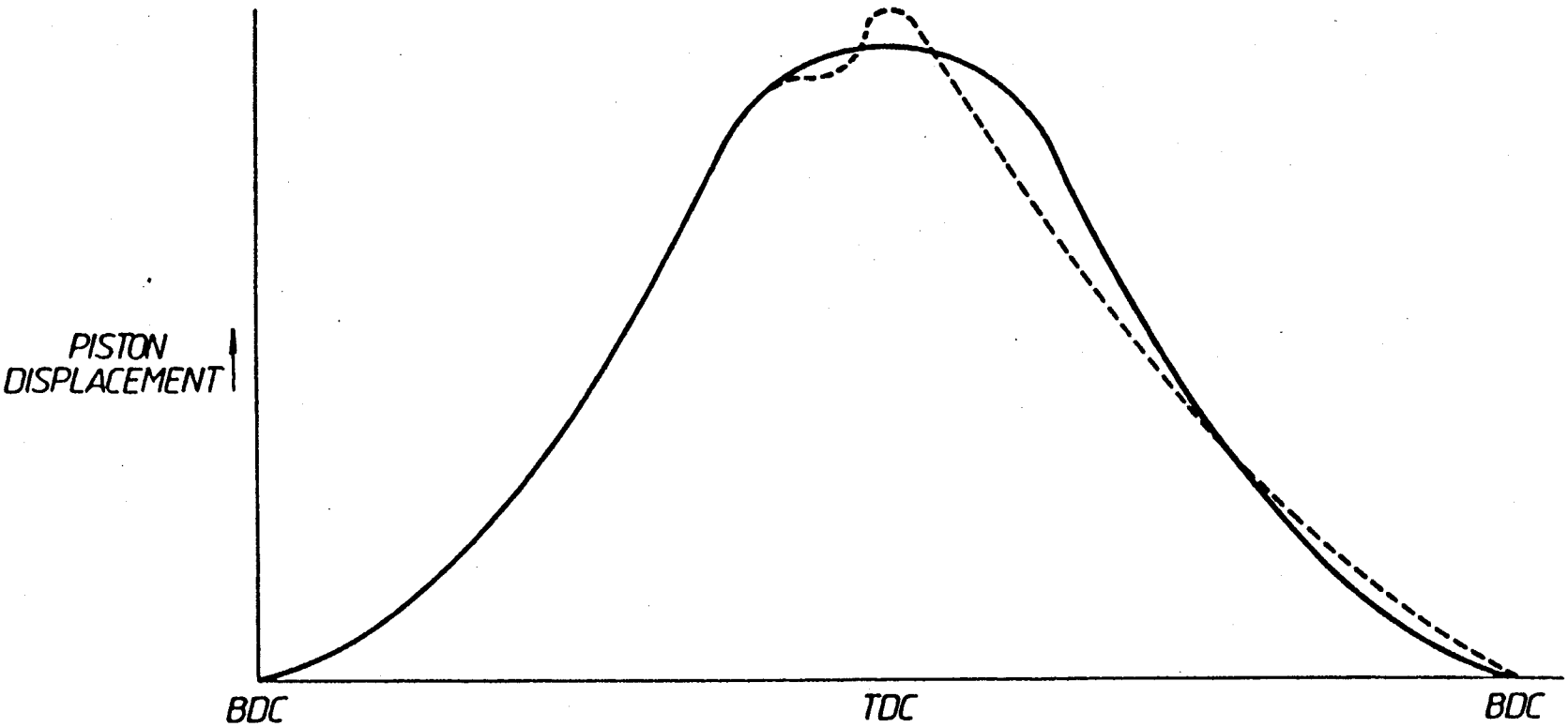
FIG. 2 is a graph showing the variation of position with time of the pistons of a conventional engine and of an engine in accordance with the invention.

The manner in which the piston motion differs from that of a conventional engine is shown by the dotted line in FIG. 2. Due to the fact that the piston moves more rapidly than previously during the initial part of the working stroke it must of course move slowly during the latter part of the working stroke. As may be seen in FIG. 2, the time/displacement curve during the working stroke for the engine of the present invention crosses that of a conventional engine at about 90° before BDC. However, due to the fact that the exhaust port opens at about 70° before BDC there is a period of about 20° before opening of the exhaust port during which the piston moves more slowly than is usual. This results in a reduction of the exhaust gas temperature and thus a reduction of the NOx content of the exhaust gas.

The cam surfaces 22,23 are thus shaped or programmed to produce the piston motion described above. It is of course not practicable to show this in FIG. 1, but it will be appreciated that the shape of each peak on each cam surface will have the same shape as the curve of FIG. 2 as modified by the dotted line.

In the construction of FIG. 1 in which the two pistons are linked by a rigid connecting rod, the motion of the two pistons is of course identical at all times.

The present invention modifies the motion of each piston principally around TDC and this modified motion will be performed simultaneously by the other piston also. However, the other piston is at this time around BDC and the slight modification to its movement at this position has no significant effect on the operation or power output from it since power is essentially produced by a piston only within about 90° after TDC.

Figure 3:
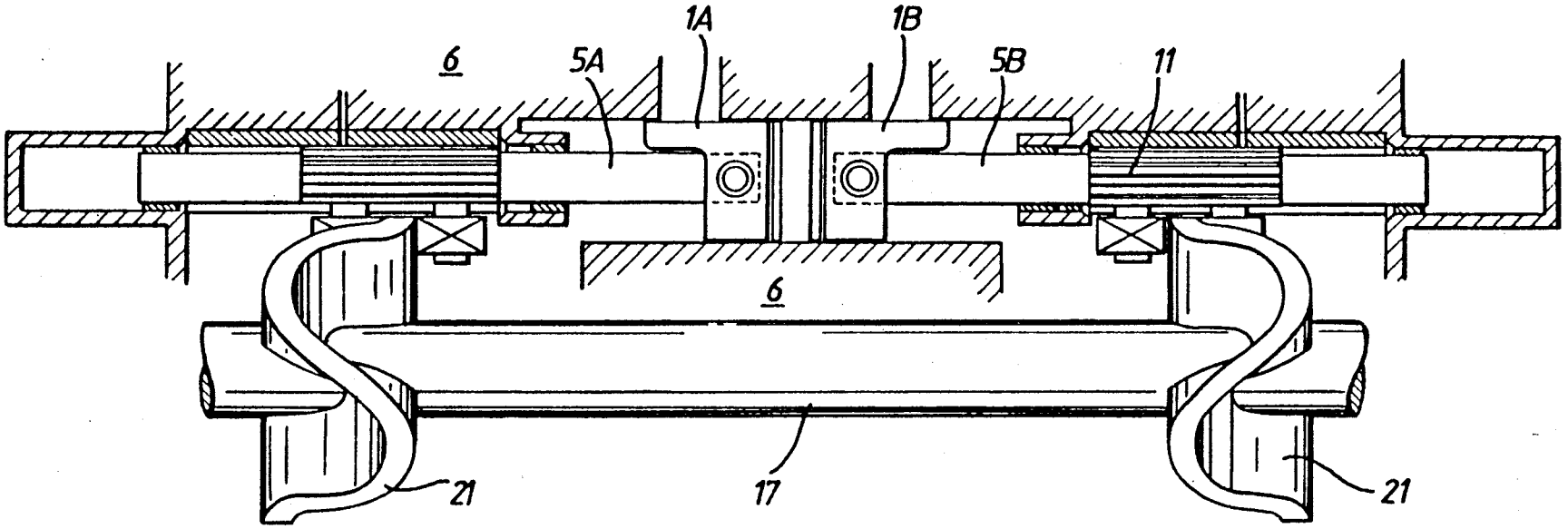
FIG. 3 is a view similar to FIG. 1 of a modified construction incorporating two pistons moving in phase and connected to respective connecting rods.

FIG. 3 illustrates a modified embodiment in which the two pistons 1A and 1B move in phase and are connected to respective connecting rods 5A and 5B. No cylinder heads are provided and the combustion chamber is defined between the two pistons. Each connecting rod is supported for linear sliding movement by respective splines 11. Each connecting rod carries rolls 24,25 which act on respective cams 21 which have the same shape as the cam 21 of FIG. 1. In other respects the construction and operation are similar to those of FIG. 1.

Figure 4:
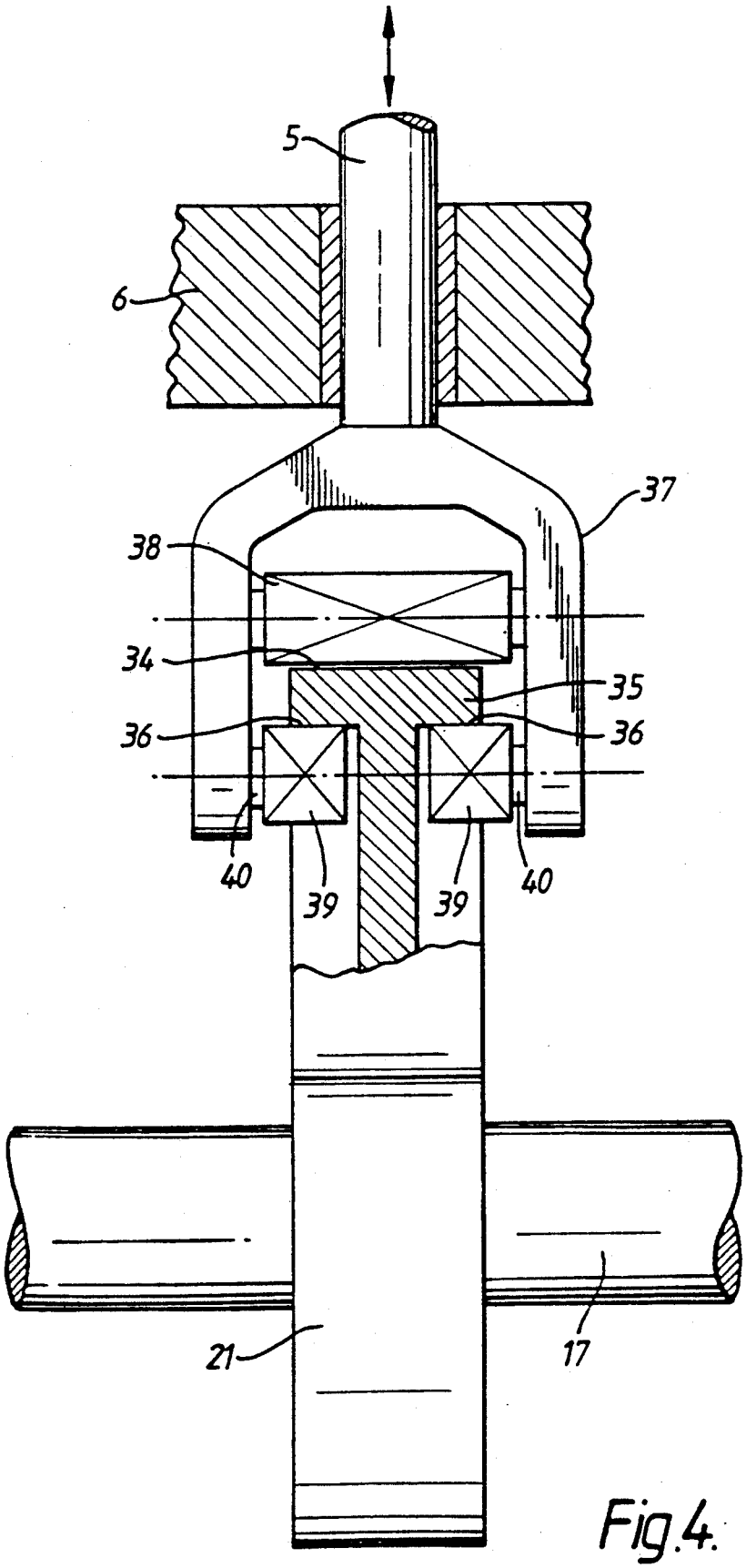
FIG. 4 is a side view partly in section of a modified form of coupling in which the output shaft extends perpendicular to the piston rod.
Figure 5:
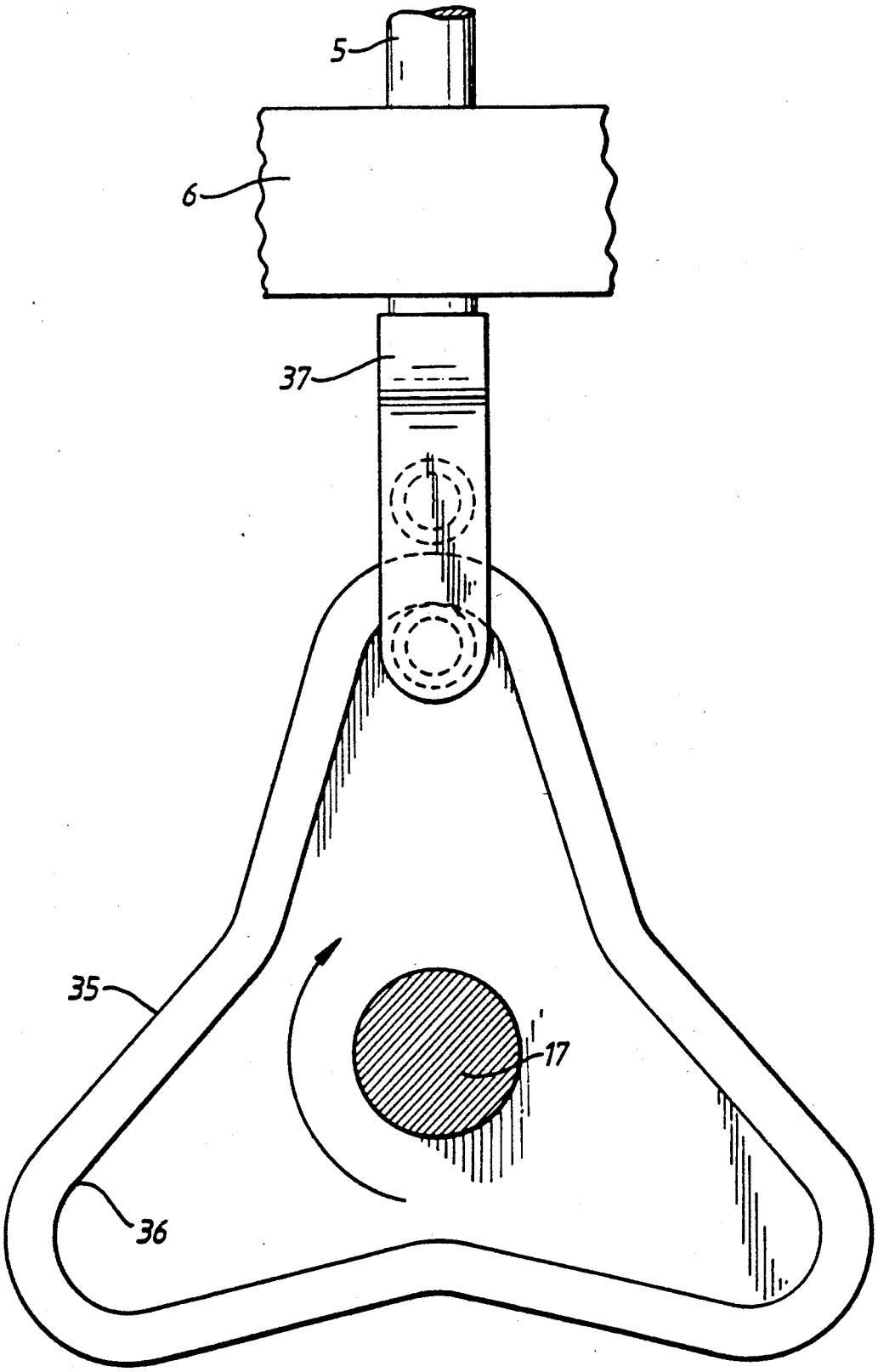
FIG. 5 is a view of the coupling of FIG. 4 in the direction of the length of the output shaft.

FIGS. 4 and 5 show a further modified engine which includes a plurality of individual piston/cylinders in a line, each piston being coupled by a respective coupling to an output shaft 17 which extends perpendicular to the connecting rods 5, only one of which is shown. At its end remote from the piston (not shown) the connecting rod has a bifurcation or yoke 37 between whose limbs are journalled a main roll 38 and, spaced below it, two further rolls 39 carried on stub shafts 40 projecting inwardly from the limbs of the yoke 37. Rotationally fixedly connected to the output shaft 17 is a radially projecting cam disc 21, integrally connected to whose outer edge is a rim 35 with an outwardly directed surface 34 and two inwardly directed surfaces 36. The rim 35 is of generally triangular shape when viewed parallel to the shaft 17 with each side being concave. The rim 35 is sandwiched between the rolls 38,39 with the roll 38 in rolling engagement with the surface 34 and the rolls 39 in rolling engagement with the surfaces 36. The distance between the surfaces 34,36 and the axis of the shaft 17 varies progressively around the rim, the maximum variation being equal to the stroke of the piston. Accordingly, as the piston reciprocates, the rim 35 and thus the shaft 17 rotate through one revolution for each three cycles of the pistons. Although it can not be illustrated, the shape of the surfaces 34,36 is the same as that of the surfaces 22,23 in FIG. 1 whereby the pistons perform the same modified motion as in the embodiment of FIG. 1.

It will be appreciated that many modifications may be effected to the embodiments described above. In particular, the engine may be of any type and whilst this will require adjustment of certain of the details and the timing at which the motion of the piston is modified this will be easily within the capabilities of the expert. The coupling between the piston an the output shaft also may take various forms and all that is of importance is that it is such that the motion of the piston is modified as described to "follow" the combustion of the fuel and optimise the combustion of the fuel and the power output of the engine.

I claim:

1. An internal combustion engine including at least one piston which is reciprocably received in a cylinder closed by a cylinder head and which is coupled to a rotary output shaft by a coupling which converts the reciprocal movement of the piston into rotary movement of the output shaft, the engine being so arranged that, in use, the fuel/air mixture in the or each cylinder ignites at a predetermined ignition time in the operating cycle of the engine, characterised in that the coupling is so arranged that on its compression stroke the speed of the piston decreases abruptly substantially at the ignition time and that the speed of the piston subsequently increases prior to reaching the top dead center position.

2. An engine as claimed in claim 1 characterised in that the coupling is so arranged that on its working stroke the maximum acceleration of the piston is reached at a position between 0° to 40°.

3. An engine as claimed in claim 1 or claim 2 characterised in that the coupling includes a connecting rod connected to the or each piston, the connecting rod being guided to perform only linear movement in the direction of its length, and a cam rotationally fixedly secured to the output shaft, the cam including a continuous annular cam surface which extends around the output shaft and is so shaped that a distance from the cam surface to said cylinder head progressively successively increases and decreases as the output shaft rotates and that the connecting rod is in sliding or rolling engagement with the cam surface.

4. An engine as claimed in claim 3 characterised in that the output shaft extends parallel to the connecting rod and that the cam surface is directed generally in the direction of the length of the output shaft and is engaged by a projection extending laterally from the connecting rod.

5. An engine as claimed in claim 3 characterised in that the output shaft extends perpendicular to the connecting rod and that the cam surface is directed in a direction transverse of the length of the output shaft.

6. An engine as claimed in claim 3 characterised in that there are two pistons in respective cylinders connected to a common connecting rod.

7. An engine as claimed in claim 3 characterised in that there are two pistons in the same cylinder which are connected to respective connecting rods and arranged to perform their compression and working strokes in synchronism.

8. An engine as claimed in claim 3 characterised in that the cam includes two continuous annular cam surfaces directed in opposite directions and that connected to the connecting rod are two engagement members in sliding or rolling contact with a respective one of the cam surfaces.

9. An engine as claimed in claim 1 characterised in that the coupling is so arranged that the piston performs two or more cycles for each complete revolution of the output shaft.

10. A method of operating an internal combustion engine including at least one piston which is reciprocably received in a cylinder and is coupled to a rotary output shaft by a coupling which converts the reciprocal movement of the piston into rotary movement of the output shaft, the method including introducing fuel and air into the cylinder and causing the fuel to ignite at a predetermined ignition time in the operating cycle of the engine characterised in that on its compression stroke the speed of the piston is caused to decrease abruptly substantially at the ignition time and that the speed of the piston is subsequently caused to increase prior to reaching the top dead center position.

11. A method as claimed in claim 10 characterised in that the piston is so moved on its working stroke that its maximum acceleration is reached at a position between 0° to 40° after top dead center.

* * * * *